US009238244B2

(12) United States Patent
Hayama

(10) Patent No.: US 9,238,244 B2
(45) Date of Patent: Jan. 19, 2016

(54) DISCHARGE APPARATUS AND DISCHARGE METHOD

(71) Applicant: DAINIPPON SCREEN MFG. CO., LTD., Kyoto (JP)

(72) Inventor: Ryuichi Hayama, Kyoto (JP)

(73) Assignee: SCREEN Holdings Co., Ltd. (JP)

( * ) Notice: Subject to any disclaimer, the term of this patent is extended or adjusted under 35 U.S.C. 154(b) by 5 days.

(21) Appl. No.: 14/312,746

(22) Filed: Jun. 24, 2014

(65) Prior Publication Data

US 2015/0028055 A1 Jan. 29, 2015

(30) Foreign Application Priority Data

Jul. 24, 2013 (JP) ..... 2013-153224

(51) Int. Cl.
*B67D 1/00* (2006.01)
*B05C 5/02* (2006.01)

(52) U.S. Cl.
CPC ..... *B05C 5/0225* (2013.01); *B05C 5/025* (2013.01)

(58) Field of Classification Search
CPC ..... B05C 5/0225; B05C 5/025; B05C 5/02; B05C 5/022; B05C 5/0212; B05C 5/0216; B05C 1/08; B05C 1/0873; B05C 3/125; B05C 3/132; B05C 3/15
USPC ..... 222/66, 57, 61, 251–257
See application file for complete search history.

(56) References Cited

U.S. PATENT DOCUMENTS 5,655,896 A * 8/1997 Konieczynski ..... B05B 5/1633 239/691
6,089,469 A 7/2000 Fusama et al.
6,726,773 B1 * 4/2004 Yanagita ..... B05B 9/047 118/323
7,191,957 B2 * 3/2007 Anderson ..... A21C 5/00 222/214
7,967,168 B2 * 6/2011 Geier ..... G05D 7/0676 222/1
2005/0092782 A1 * 5/2005 Takahashi ..... H05K 3/305 222/504
2006/0254389 A1 * 11/2006 Ickinger ..... B22F 1/0003 75/684
2012/0145743 A1 6/2012 Ikushima ..... 222/1
2012/0312838 A1 12/2012 Clark et al. ..... 222/146.5

FOREIGN PATENT DOCUMENTS

CN 102458685 A 5/2012
CN 102803123 A 11/2012

(Continued)

OTHER PUBLICATIONS

Korean Office Action dated Sep. 30, 2015 in corresponding Korean Patent Application No. 10-2014-0064332 (7 pages).

(Continued)

*Primary Examiner* — Lien Ngo
(74) *Attorney, Agent, or Firm* — Ostrolenk Faber LLP

(57) ABSTRACT

A discharge apparatus 1 comprises a feeder part 41 which is provided on a flow path of a discharge material from a supply part 10 to a nozzle 50 and feeds the discharge material in the flow path at a predetermined flow rate from the supply part 10 toward the nozzle 50 and a plurality of pressurizers 31, 32 provided in parallel to each other on the flow path and each having a function of temporarily storing the discharge material in a storage space and a function of pressurizing the discharge material stored in the storage space and feeding the discharge material under pressure to the feeder part 41. The plurality of pressurizers 31, 32 operate complementarily manner, thereby a constant pressure is applied to the discharge material fed to the feeder part 41.

12 Claims, 10 Drawing Sheets

(56) References Cited

FOREIGN PATENT DOCUMENTS

| | | | |
|---|---|---|---|
| JP | 11-019569 | A | 1/1999 |
| JP | 2006-266158 | A | 10/2006 |
| JP | 2008-272740 | A | 11/2008 |
| JP | 2012-211568 | A | 11/2012 |
| WO | WO 2011/087961 | A1 | 7/2011 |

OTHER PUBLICATIONS

Chinese Notice of Allowance dated Sep. 16, 2015 in corresponding Chinese Patent Application No. 201410319706.4 (8 pages).

* cited by examiner

DISCHARGE APPARATUS AND DISCHARGE METHOD

CROSS REFERENCE TO RELATED APPLICATION

The disclosure of Japanese Patent Application No. 2013-153224 filed on Jul. 24, 2013 including specification, drawings and claims is incorporated herein by reference in its entirety.

BACKGROUND OF THE INVENTION

1. Field of the Invention

This invention relates to a discharge apparatus and a discharge method for discharging a paste-like discharge material and particularly to a technique for stably discharging highly viscous paste.

2. Description of the Related Art

As a technique for forming a wiring pattern on a surface of a substrate such as a glass substrate or a solar cell substrate or forming an active material layer on a current collector surface, a technique for applying paste-like application liquid containing a wiring material or an active material to a substrate or the like is known. For example, an applying apparatus described in JP2013-004400A produces an electrode for battery by applying paste containing an active material and a conductive material to a support body by a die coating method. Further, in this technique, the paste is caused to constantly flow to prevent the cohesion of dispersant added to the paste by recirculating the paste between a tank for storing the paste and a nozzle.

The above conventional technique is for forming a uniform coating film by coating. Although a shearing speed is not clearly specified in the above literature, a numerical value example of 3500 cp (3.5 Pa·s) is described as a typical paste viscosity. On the other hand, to form a fine pattern or thick pattern by such a coating technique, paste having a higher viscosity (more specifically, having a viscosity which is, for example, about 10 to 100-fold of the above numerical value) needs to be used.

At this time, such highly viscous paste needs to be stably discharged at a constant flow rate from the nozzle, but it is not easy to cause the highly viscous paste to reliably flow in a flow path with good controllability and discharge it from the nozzle. Particularly, a technique capable of stable discharge at a low flow rate, which is necessary in forming a fine pattern, has not been established thus far.

SUMMARY OF THE INVENTION

This invention was developed in view of the above problem and aims to provide a technique capable of reliably and stably discharging even a highly viscous paste-like discharge material.

To attain the object above, a discharge apparatus according to the present invention comprises: a nozzle which discharges a paste-like discharge material supplied from a supply part; a feeder part which is provided on a flow path of the discharge material from the supply part to the nozzle and feeds the discharge material in the flow path at a predetermined flow rate from the supply part side toward the nozzle side; a plurality of pressurizers provided in parallel to each other on the flow path between the supply part and the feeder part and each having a function of temporarily storing the discharge material supplied from the supply part in a storage space and a function of pressurizing the discharge material stored in the storage space and feeding the discharge material under pressure to the feeder part; and a controller which causes at least one of the pressurizers to pressurize the discharge material in the flow path communicating with the feeder part so that a predetermined positive pressure is applied to the discharge material in the flow path and causes the discharge material to be supplied from the supply part to at least one of the pressurizers not pressurizing the discharge material.

Further, to attain the object above, a discharge method for discharging a paste-like discharge material from a nozzle according to the present invention comprises: a first step of arranging a pressurizer and a feeder part in order along a flowing direction of the discharge material on a flow path of the discharge material from a supply part configured to supply the discharge material to the nozzle; a second step of feeding the discharge material supplied from the supply part under pressure to the feeder part by pressurizing the discharge material by the pressurizer; and a third step of feeding the discharge material fed under pressure from the pressurizer at a predetermined flow rate to the nozzle by the feeder part while performing the second step; wherein: in the first step, a plurality of the pressurizers each having a function of temporarily storing the discharge material supplied from the supply part in a storage space and a function of pressurizing the discharge material stored in the storage space and feeding the discharge material under pressure to the feeder part are disposed in the flow path in a state connected in parallel to each other; and in the second step, while at least one of the pressurizers applies a predetermined positive pressure to the discharge material in the flow path communicating with the feeder part by pressurizing the discharge material, the discharge material is supplied from the supply part to at least one of the pressurizers not pressurizing the discharge material.

It is considered to apply a known technology such as various pumps as the feeder for feeding the discharge material. To stably feed a highly viscous discharge material at a predetermined flow rate, a discharge ability capable of merely feeding highly viscous fluid is not sufficient and a high suction ability for the highly viscous fluid with little pulsation of a feeding amount is further required. However, the feeder device having all such abilities has not been realized thus far. Particularly, it is difficult to stably suck the highly viscous fluid and the shortage of a suction amount tends to lead to a fluctuation of the feeding amount.

Accordingly, in the invention, the pressurizers are provided in the flow path upstream of the feeder part in the flowing direction of the discharge material to apply a positive pressure to the discharge material in the flow path at the side upstream of the feeder part. Thus, the discharge material is fed under pressure and forcibly fed to the feeder part, so to speak. Thus, even the feeder part having an insufficient suction ability can be applied without problem if the feeder part can feed the highly viscous discharge material quantitatively without pulsation. That is, by combining the pressurizers and the feeder part, the highly viscous discharge material can be stably fed at a predetermined flow rate.

Further, by connecting the plurality of pressurizers to the flow path in parallel to each other, the pressurizers can be caused to operate in a complementary manner, whereby the discharge material can be continuously pressurized. More specifically, an operation of receiving the supply of the discharge material from the supply part and replenishing the discharge material by some of the pressurizers while pressurizing the discharge material by some of the pressurizers can be performed while successively switching the pressurizers. This enables the discharge material to be pressurized by at least one pressurizer, whereby the discharge material can be continuously pressurized without interruption.

As just described, according to the invention, the discharge material pressurized by the pressurizers is supplied to the feeder part for feeding the discharge material to the nozzle. The plurality of pressurizers arranged in parallel pressurize the discharge material and replenish the discharge material from the supply part in a complementary manner. Thus, even a highly viscous paste-like discharge material can be reliably and stably discharged.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENT

Figure 1:
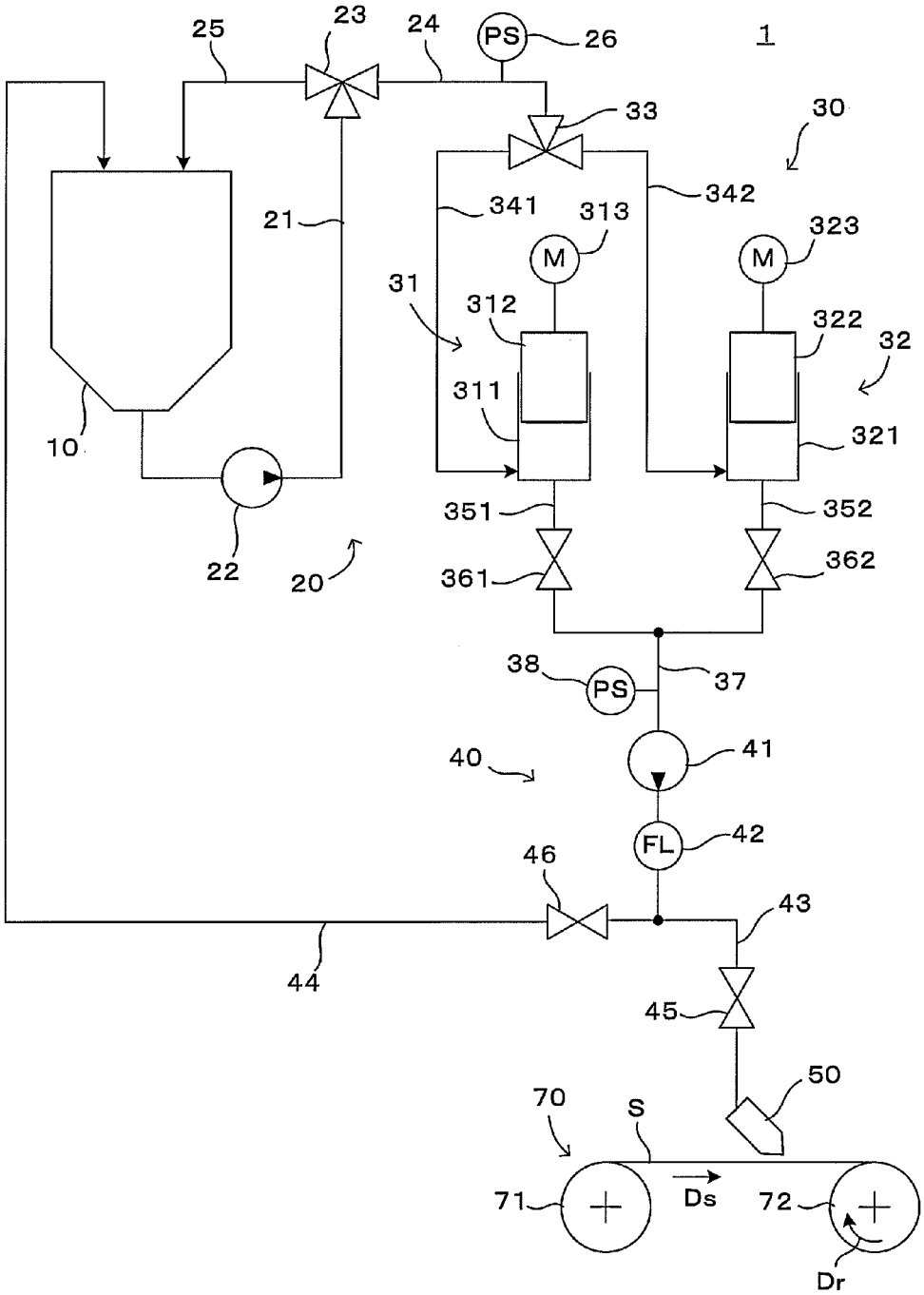
FIG. 1 is a diagram showing one embodiment of a discharge apparatus according to this invention.

FIG. 1 is a diagram showing one embodiment of a discharge apparatus according to this invention. More specifically, FIG. 1 is a view showing a schematic configuration of an applying apparatus 1 including one embodiment of a discharge apparatus according to this invention. This applying apparatus 1 is an apparatus for applying paste-like application liquid to a sheet-like base material S fed by a roll-to-roll method and can be used, for example, in the production of electrodes for batteries such as lithium ion secondary batteries.

This applying apparatus 1 includes a hopper tank 10 for storing the application liquid to be applied inside, and a nozzle 50 for discharging the application liquid supplied from the hopper tank 10. The application liquid in the hopper tank 10 is fed toward the nozzle 50 by a liquid feeding system (to be described later) provided between the hopper tank 10 and the nozzle 50, and discharged from a discharge port provided on the tip of the nozzle 50.

The base material S to which the application liquid is to be applied is arranged at a position facing the nozzle 50 by a conveying unit 70. Specifically, the base material S in the form of a long sheet wound into a roll is set on a feed roller 71 of the conveying unit 70 and one end part of the base material S is wound on a take-up roller 72. By the rotation of the take-up roller 72 in a direction of an arrow Dr of FIG. 1, the base material S is dispensed from the feed roller 71, fed in a direction of an arrow Ds and taken up on the take-up roller 72. The nozzle 50 is arranged to face a surface of the base material S mounted on the feed roller 71 and the take-up roller 72 in this way. Thus, the application liquid discharged from the nozzle 50 is applied on the surface of the base material S. By the feed of the base material S in the direction of the arrow Ds, the application liquid can be applied on the base material S while relatively scanning and moving the nozzle 50 with respect to the base material S.

Here, an electrode for battery formed by laminating an active material layer on a surface of a current collector can be produced, for example, using a conductive sheet, which is made of metal or the like and functions as the current collector, as the base material S and paste containing an active material as the application liquid.

Figure 2:
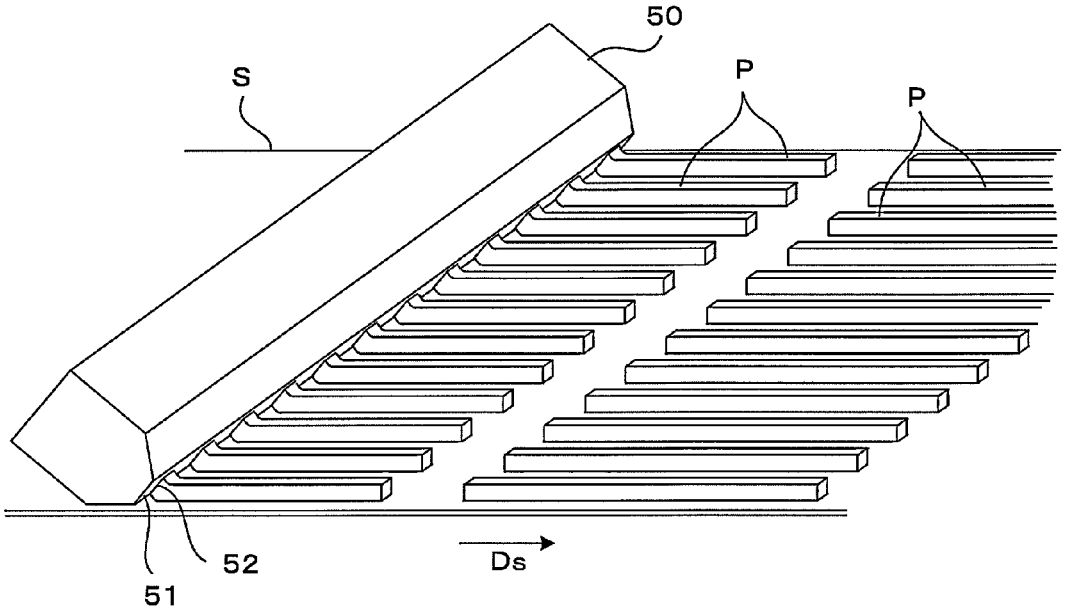
FIG. 2 is a view diagrammatically showing an example of paste application in this applying apparatus.

FIG. 2 is a view diagrammatically showing an example of paste application in this applying apparatus. On a lower surface 51 of the nozzle 50 arranged to face the base material S fed in the direction of the arrow Ds, a plurality of discharge ports 52 each for continuously discharging the application liquid are arranged at equal intervals in a width direction of the base material S perpendicular to the feeding direction Ds. The highly viscous paste-like application liquid continuously discharged from each discharge port is transported in the direction of the arrow Ds with a movement of the base material S after being landed on the surface of the base material S. In this way, linear pattern elements P of the application liquid continuously extending in the feeding direction Ds are formed on the base material S. As described later, this applying apparatus 1 can also form pattern elements continuously extending along the feeding direction Ds of the base material S without any interruption. Further, it is also possible to form pattern elements interrupted in the feeding direction Ds as shown in FIG. 2 by temporarily stopping the discharge of the application liquid from each discharge port 52.

A cross-sectional shape of the pattern element depends on an opening shape of each discharge port 52. Particularly in the case of using the highly viscous application liquid, the pattern elements having a cross-sectional shape substantially equal to the opening shape of the discharge ports 52 can be formed. This enables the formation of pattern elements having a high ratio of height to width, i.e. a high aspect ratio. If the base material S functions as a current collector and the linear pattern elements formed by the application liquid contain an active material, it is possible to produce an electrode for battery structured such that linear pattern elements containing the active material and having a high aspect ratio are formed on a current collector surface. Since the electrode having such a structure has an active material layer having a large surface area for a used amount of the active material, a battery with good high-speed charge/discharge properties can be configured.

It is also possible to form pattern elements having a relatively large width on the surface of the base material S by widening the opening shape of each discharge port or using a slit-like discharge port as in the technique described as the background art. Also in this case, an electrode having a high density and including a thick active material layer can be produced by using highly viscous application liquid. This enables a battery with a large capacity to be configured.

To form such pattern elements with excellent dimensional accuracy, the highly viscous application liquid needs to be stably discharged at a low flow rate from the nozzle 50. The configuration of the liquid feeding system in the applying apparatus 1 to enable this is described with reference to FIG. 1 again. Note that an assumed viscosity of the application liquid used in this applying apparatus 1 is about 100 Pa·s to 300 Pa·s at a shearing speed of 10 $s^{-1}$.

The liquid feeding system in this applying apparatus 1 includes a guiding unit 20 for guiding the application liquid in the hopper tank 10 to a flow path to start the flow, a pressurizing unit 30 for feeding the application liquid supplied via the guiding unit 20 while applying a constant positive pressure and a feeding unit 40 for feeding the application liquid fed from the pressurizing unit 30 to the nozzle 50 while controlling the flow rate of the application liquid to a constant flow rate. These are arranged in this order on the flow path of the application liquid from the hopper tank 10 to the nozzle 50.

In the guiding unit 20, a supply pump 22 is provided at an intermediate position of a pipe 21 connected to a bottom part of the hopper tank 10 and communicating with an inner space of the hopper tank 10. The supply pump 22 is for causing the application liquid in the hopper tank 10 to flow in the pipe 21 and desirably capable of feeding the highly viscous application liquid at a stable flow rate. A screw pump can be, for example, used as such a pump. For example, a mohno pump, which is one type of a uniaxial screw pump, can be suitably applied.

The pipe 21 is connected to a three-way valve 23 at a side downstream of the supply pump 22 in a flowing direction of the application liquid. This three-way valve 23 has a function of controlling the supply of the application liquid to the pressurizing unit 30 and the stop of the supply. That is, the three-way valve 23 is for selectively switching a flow destination of the application liquid fed from the supply pump 22 to a pipe 24 connected to the pressurizing unit 30 in a subsequent stage and a recirculation pipe 25 returning to the hopper tank 10. Thus, this three-way valve 23 is referred to as a "liquid supply valve" below.

When a flow path extending from the pipe 21 to the recirculation pipe 25 is opened by the liquid supply valve 23, the application liquid flows in the pipe 21 from the hopper tank 10 by the action of the supply pump 22 and flows in a recirculation flow path returning to the hopper tank 10 by way of the liquid supply valve 23 and the recirculation pipe 25. If the highly viscous application liquid has a thixotropy property, a shear force needs to be constantly applied to the application liquid to maintain the fluidity of the application liquid. By circulating the application liquid by way of the recirculation flow path except when the application liquid is supplied backward, a state with high fluidity and low viscosity can be maintained by applying a shear force to the application liquid. Further, there is also a degassing action of removing air bubbles contained in the application liquid in the tank, particularly in the application liquid immediately after being poured from outside. On the other hand, if the flow path extending from the pipe 21 to the pipe 24 is opened by the liquid supply valve 23, the application liquid is supplied to the pressurizing unit 30. A pressure sensor (PS) 26 for measuring a pressure in the pipe is connected to the pipe 24.

The pressurizing unit 30 is a dual syringe unit with two syringe pumps 31, 32. More specifically, the pressurizing unit 30 includes two syringe pumps 31, 32 connected in parallel with each other on a flow path from the guiding unit 20 to the nozzle 50. One syringe pump (hereinafter, referred to as a "first syringe" according to need) 31 includes a cylinder 311 capable of storing the application liquid inside, a piston 312 to be inserted and withdrawn into and from the cylinder 311 and a motor 313 for driving the piston 312 to insert and withdraw the piston 312 into and from the cylinder 311. The other syringe pump (hereinafter, referred to as a "second syringe" according to need) 32 also has a similar structure. Specifically, the second syringe 32 includes a cylinder 321 capable of storing the application liquid inside, a piston 322 to be inserted and withdrawn into and from the cylinder 321 and a motor 323 for driving the piston 322 to insert and withdraw the piston 322 into and from the cylinder 321.

The pipe 24 for supplying the application liquid from the guiding unit 20 is connected to a three-way valve 33 and the flow path of the application liquid is branched into a pipe 341 connected to the first syringe 31 and a pipe 342 connected to the second syringe 32 by the three-way valve 33. By actuating this three-way valve 33, the application liquid flowing in the pipe 24 is supplied to the first syringe 31 via the pipe 341 or to the second syringe 32 via the pipe 342. As just described, the three-way valve 33 has a function of switching the supply destination of the application liquid supplied from the guiding unit 20 between the first syringe 31 and the second syringe 32. Thus, the three-way valve 33 is referred to as a "syringe switching valve" below. Further, the motors 313, 323 for respectively driving the pistons 312, 322 are respectively referred to as a "first syringe drive motor" and a "second syringe drive motor".

The pipes 341, 342 respectively communicate with the inner spaces of the cylinders 311, 321. Thus, for example, in a phase where the syringe switching valve 33 causes the pipes 24 and 341 to communicate and the first syringe drive motor 313 pulls up the piston 312 to increase the volume of the inner space of the first syringe 31, the application liquid supplied from the guiding unit 20 via the pipe 341 is filled into the inner space of the first syringe 31. On the other hand, for example, in a phase where the syringe switching valve 33 causes the pipes 24 and 342 to communicate and the second syringe drive motor 323 pulls up the piston 322 to increase the volume of the inner space of the second syringe 32, the application liquid supplied from the guiding unit 20 via the pipe 342 is filled into the inner space of the second syringe 32. By interlocking the syringe switching valve 33 with the first syringe drive motor 313 and the second syringe drive motor 323, the application liquid can be filled into the inner space of each of the first and second syringes 31, 32.

A pipe 351 is connected to an output part of the first syringe 31, and a first syringe liquid discharge valve 361 in charge of the discharge of the application liquid from the first syringe 31 and the stop of this discharge is disposed at an intermediate position of the pipe 351. Similarly, a pipe 352 is connected to an output part of the second syringe 32, and a second syringe liquid discharge valve 362 in charge of the discharge of the application liquid from the second syringe 32 and the stop of this discharge is disposed at an intermediate position of the pipe 352. Two pipes 351, 352 join at a side downstream of the first and second syringe liquid discharge valve 361, 362 in the flowing direction of the application liquid. A common pipe 37 after the joint is connected to the feeding unit 40 in a subsequent stage. Further, a pressure sensor (PS) 38 for measuring a pressure in the pipe is connected to the common pipe 37.

For example, in a phase where the first syringe drive motor 313 pushes down the piston 312 to reduce the volume of the inner space of the first syringe 31, the application liquid stored in the first syringe 31 is pressurized. If the first syringe liquid discharge valve 361 is opened in this state, the application liquid is fed under pressure to the feeding unit 40 via the pipe 351 and the common pipe 37. On the other hand, for example, in a phase where the second syringe drive motor 323 pushes down the piston 322 to reduce the volume of the inner space of the second syringe 32, the application liquid stored in the second syringe 32 is pressurized. If the second syringe liquid discharge valve 362 is opened in this state, the application liquid is fed under pressure to the feeding unit 40 via the pipe 352 and the common pipe 37. Two liquid discharge valves 361, 362 can be independently opened and closed, so that any of a state where the both are closed, a state where only one is closed and a state where the both are open can be set.

The application liquid supplied from the pressurizing unit 30 configured as just described is fed to the feeding unit 40. The feeding unit 40 includes a discharge pump 41 for feeding the application liquid fed under pressure from the pressurizing unit 30 at a constant flow rate to a downstream side. The discharge pump 41 is desirably capable of feeding the highly viscous application liquid at a stable flow rate and a screw pump can be, for example, used as such. For example, a mohno pump which is one type of a uniaxial screw pump can feed highly viscous fluid at a low flow rate without pulsation, and can be suitably applied for such a purpose.

In this applying apparatus 1, the discharge pump 41 determines the amount of the application liquid to be supplied to the nozzle 50 and the configuration of the pressurizing unit 30 and the like is for assisting a feed amount control by the discharge pump 41. Thus, the discharge pump 41 is desirably capable of a highly accurate flow rate control at a low flow rate. In the case of using a commercially available mohno pump for this purpose, a precision-type product having a small clearance between a stator and a rotor is particularly preferably used.

A flowmeter 42 for detecting the flow rate of the application liquid fed from the discharge pump 41 is provided downstream of the discharge pump 41 in the flowing direction of the application liquid. By controlling the discharge pump 41 based on a flow rate detection value detected by the flowmeter 42, the flow rate of the application liquid fed to the nozzle 50 is adjusted to a predetermined value. Note that a filter for removing foreign substances contained in the application liquid and coagulation of the application liquid may be further provided between the discharge pump 41 and the flowmeter 42.

At a side downstream of the flowmeter 42, the pipe is branched into an output pipe 43 extending toward the nozzle 50 and a recirculation pipe 44 returning to the hopper tank 10. A nozzle flow path opening valve 45 is disposed in the output pipe 43, whereas a return flow path opening valve 46 is disposed in the recirculation pipe 44. When the nozzle flow path opening valve 45 is opened, the application liquid fed from the discharge pump 41 is supplied to the nozzle 50 via the output pipe 43 and discharged from the discharge ports of the nozzle 50. On the other hand, when the return flow path opening valve 46 is opened, the application liquid fed from the discharge pump 41 is returned to the hopper tank 10 via the recirculation pipe 44. Since the return flow path of the application liquid including the entire liquid feeding system is formed at this time, an increase in viscosity can be suppressed by recirculating the application liquid in the entire liquid feeding system even if the application liquid is not discharged from the nozzle 50.

Figure 3:
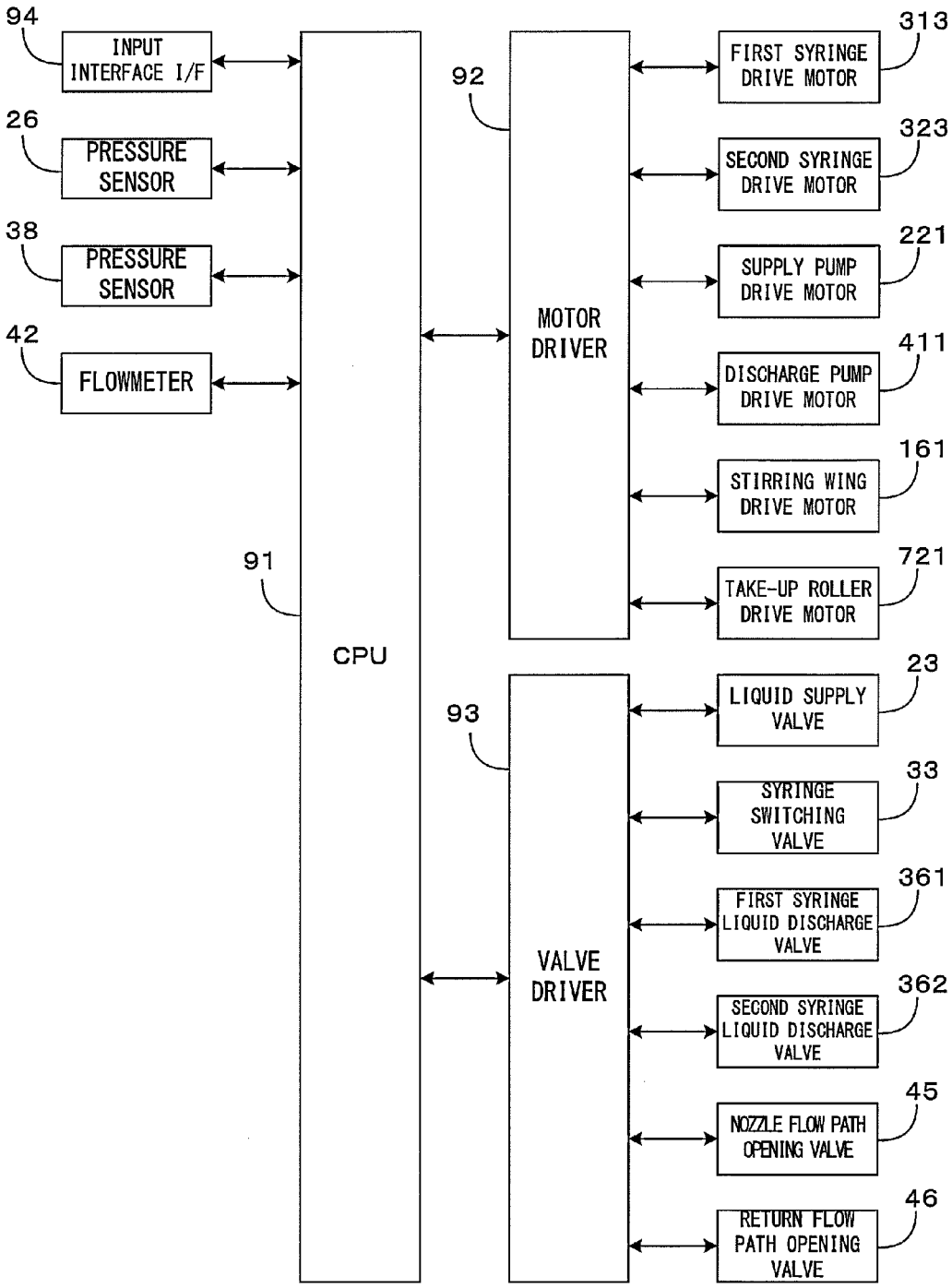
FIG. 3 is a block diagram showing a control configuration of this applying apparatus.

FIG. 3 is a block diagram showing a control configuration of this applying apparatus. This applying apparatus 1 includes a CPU (Central Processing Unit) 91 for controlling the operation of the entire apparatus, a motor driver 92 for driving motors provided in the respective units according to a control command from the CPU 91 and a valve driver 93 for driving the valves provided in the respective units according to a control command from the CPU 91.

The motor driver 92 gives drive signals to the first syringe drive motor 313, the second syringe drive motor 323, a supply pump drive motor 221 coupled to the supply pump 22 to drive the supply pump 22, a discharge pump drive motor 411 coupled to the discharge pump 41 to drive the discharge pump 41, a stirring wing drive motor 161 for driving stirring wings (FIG. 7, etc.) provided in the hopper tank 10 to stir the application liquid as described later and a take-up roller drive motor 721 for driving and rotating the take-up roller 72 for taking up the base material S and the like, and operates these drive motors in accordance with a control signal from the CPU 91.

Further, the valve driver 93 gives drive signals to various valves provided in the apparatus, specifically the liquid supply valve 23, the syringe switching valve 33, the first syringe liquid discharge valve 361, the second syringe liquid discharge valve 362, the nozzle flow path opening valve 45 and the return flow path opening valve 46 and the like and opens and closes these in accordance with a control signal from the CPU 91. These respective valves, the first syringe liquid discharge valve 361 in particular, the second syringe liquid discharge valve 362, the nozzle flow path opening valve 45 and the return flow path opening valve 46 are preferably of such a type that a valve linearly moves back and forth by being motor-driven from the need to switch the flow paths of the application liquid in a short time with good controllability. In this case, the valve driver 93 has a function of driving the motors for moving these valves back and forth.

An input interface (I/F) 94 for receiving an operation input from a user is connected to the CPU 91. A process corresponding to an instruction given from the user via the input interface 94 is performed by the CPU 91. Further, pressure detection signals from the pressure sensors 26, 38 respectively connected to the pipes 24, 37 and a flow rate detection signal from the flowmeter 42 are input to the CPU 91, and the CPU 91 controls the operation of each unit based on these input signals.

Next, the operation principle of the applying apparatus 1 configured as described above is described. In this applying apparatus 1, a mohno pump which is a uniaxial eccentric screw pump is used as the discharge pump 41. The mohno pump is excellent in property in stably feeding fluid even at a low flow rate without pulsation. However, generally, even a pump capable of handling highly viscous fluid does not necessarily have a high ability in sucking the highly viscous fluid. Specifically, a pump of this type has a function of stably feeding fluid sucked internally, but may have an insufficient ability in sucking the highly viscous fluid into the pump from outside (upstream side).

The mohno pump functions as a pump by sucking fluid into a cavity formed between a stator and a rotor at one side and pushing out the fluid at the other side by the rotation of the rotor. However, if the viscosity of the fluid is high, a sufficient amount of the fluid cannot be sucked and a ratio (volume efficiency) of an actual feed amount to a theoretical feed amount obtained from the volume of the cavity is known to decrease. That is, with the highly viscous fluid, a stable feed amount as indicated by a theoretical value cannot be obtained.

Accordingly, in this applying apparatus 1, the pressurizing unit 30 is provided upstream of the discharge pump 41 in the flowing direction of the application liquid to pressurize the application liquid and forcibly feed the application liquid under pressure to the discharge pump 41. Particularly, by constantly applying a constant positive pressure to the application liquid upstream of the discharge pump 41, a stable amount of the application liquid can be fed from the discharge pump 41 by compensating for the insufficient sucking ability.

Various methods for pressurizing the application liquid are considered. In this applying apparatus 1, a method by a syringe pump for pressurizing application liquid stored in a cylinder by pushing a piston is adopted. In the case of using the syringe pump, the application liquid can be stably pressurized and a pressing force can be relatively easily controlled. However, pressurization by a single syringe pump cannot be continued if all the application liquid stored in the cylinder is pushed out. Thus, there is a problem of intermittent pressurization. Accordingly, in this applying apparatus 1, a constant pressure can be continuously applied to the application liquid by inserting two syringe pumps in parallel into the flow path of the application liquid and alternately performing the pressure feed and replenishment of the application liquid by these syringe pumps as described in detail below.

Figure 4A:
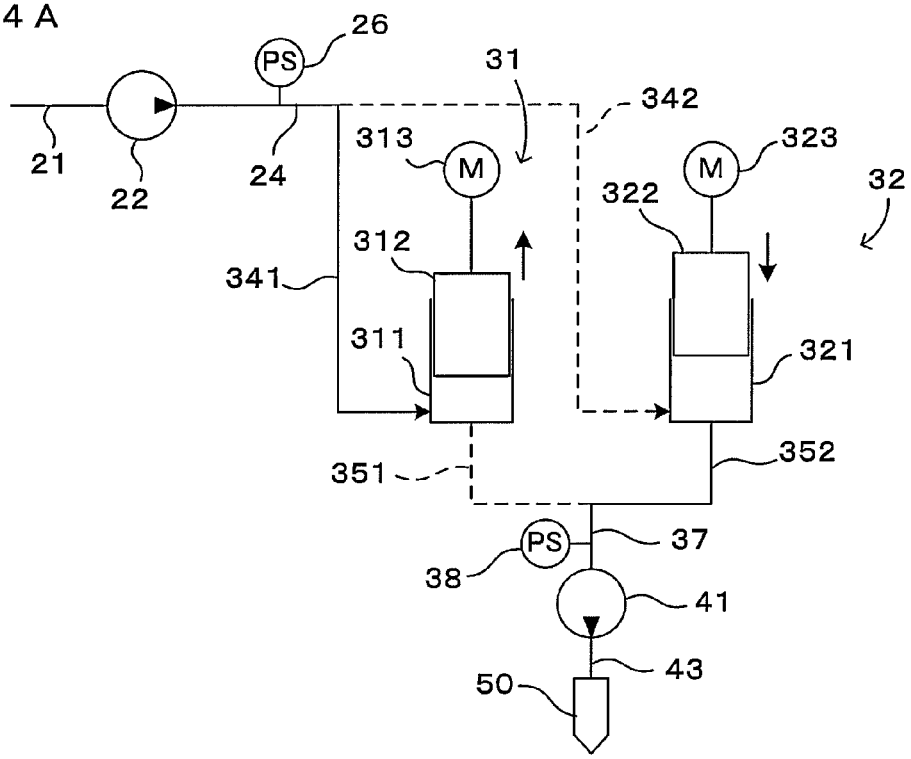
FIGS. 4A and 4B are views diagrammatically showing a basic operation of this applying apparatus.
Figure 4B:
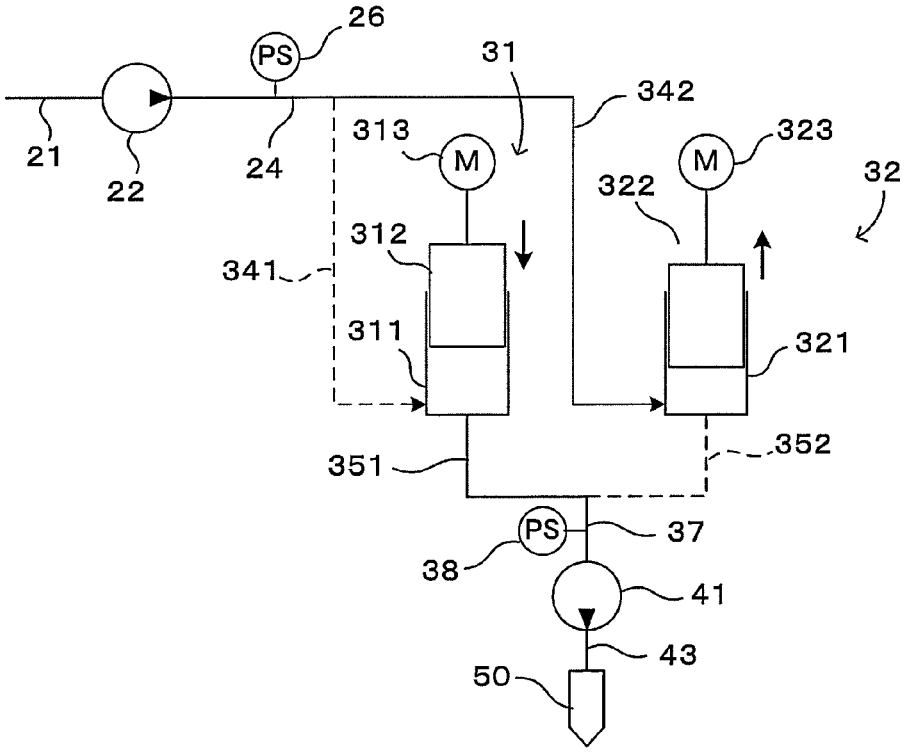

FIGS. 4A and 4B are views diagrammatically showing a basic operation of this applying apparatus 1. Note that, in FIGS. 4A and 4B, the flow paths of the application liquid opened by opening and closing the valves are shown in solid line and those closed thereby are shown in broken line. Further, the valves are not shown to make FIGS. 4A and 4B easy to see. FIGS. 4A and 4B show two phases different from each other in a state transition of the apparatus.

In the phase shown in FIG. 4A, a flow path extending from the supply pump 22 to the first syringe 31 via the pipe 341 is open, whereas a flow path extending from the first syringe 31 to the discharge pump 41 via the pipe 351 is closed. If the piston 312 of the first syringe 31 is pulled up as shown by an arrow at this time, the application liquid supplied from the hopper tank 10 via the supply pump 22 is filled into the first syringe 31.

Contrary to this, on the side of the second syringe 32, a flow path extending from the supply pump 22 to the second syringe 32 via the pipe 342 is closed, whereas a flow path extending from the second syringe 32 to the discharge pump 41 via the pipe 352 is open. If the piston 322 of the second syringe 32 is pulled down as shown by an arrow at this time, the application liquid in the second syringe 32 is pressurized and pushed out to the pipe 352, and the thus pressurized application liquid is supplied to the discharge pump 41.

Since the application liquid is pressurized at a side upstream of the discharge pump 41, the application liquid is pushed into the cavity formed with the rotation of the rotor of the discharge pump 41 from outside and a suction amount is sufficient. Thus, the application liquid can be fed at the flow rate indicated by the theoretical value by the rotation of the rotor. By opening a flow path extending from the discharge pump 41 to the nozzle 50 via the output pipe 43, the application liquid is discharged at a discharge rate as indicated by a design value from the nozzle 50.

Since the flow path from the supply pump 22 to the second syringe 32 is closed and the flow path from the first syringe 31 to the discharge pump 41 is closed, the influence of an operation of filling the application liquid into the first syringe 31 on an operation of pressurizing the application liquid by the second syringe 32 is avoided. Simultaneously with this, the influence of the operation of pressurizing the application liquid by the second syringe 32 on the operation of filling the application liquid into the first syringe 31 is also avoided.

On the other hand, in the phase shown in FIG. 4B, contrary to the above, a flow path extending from the hopper tank 10 to the second syringe 32 via the supply pump 22 is open, whereas a flow path from the first syringe 31 to the discharge pump 41 is open. In this state, the application liquid can be filled into the second syringe 32 during and independently of the pressurization of the application liquid by the first syringe 31.

By alternatively exhibiting these two states, the application liquid on the side upstream of the discharge pump 41 can be constantly pressurized to be stably fed from the discharge pump 41. The CPU 91 detects the pressure in the pipe by the pressure sensor 38 connected to the common pipe 37 upstream of the discharge pump 41 and controls the first syringe 31 and the second syringe 32 (more specifically the first syringe drive motor 313 and the second syringe drive motor 323) based on that output. By doing so, the positive pressure applied to the application liquid can be maintained to be constant. As a result, the application liquid can be fed at a constant flow rate without pulsation by maintaining the volume efficiency of the discharge pump 41 to be constant.

Further, the CPU 91 controls the supply pump 22 based on a detection result of the pressure sensor 26 connected to the pipe 24 to maintain the pressure of the application liquid in the pipes 341, 342 in a predetermined range. This enables the application liquid to be efficiently and reliably filled into the first syringe 31 and the second syringe 32. That is, the supply pump 22 has a function of compensating for a reduction in the suction ability of the first and second syringes 31, 32. Since the amount of the application liquid filled into the syringe is mainly determined by how much the piston is pulled up, the pressure detected by the pressure sensor 26 has only to be in a predetermined positive pressure range and needs not necessarily be constant.

Figure 5A:
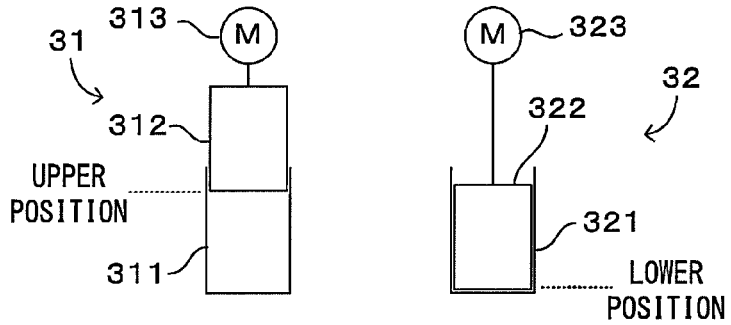
FIGS. 5A to 5D are views showing state transitions of the two syringes, focusing on movements of the pistons.
Figure 5B:
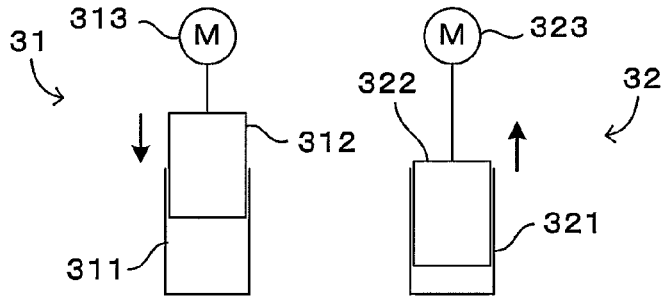

FIGS. 5A to 5D are views showing state transitions of the two syringes, focusing on movements of the pistons. FIG. 5A shows a state where the piston 312 of the first syringe 31 is pulled up to a predetermined "upper position" to fill a sufficient amount of the application liquid inside, whereas the piston 322 of the second syringe 32 is pushed down to a predetermined "lower position" to push out substantially all the application liquid inside. From this state, the piston 312 of the first syringe 31 is pushed down to push out the application liquid inside as shown in FIG. 5B. On the other hand, the piston 322 of the second syringe 32 is gradually pulled up to fill the application liquid.

Figure 5C:
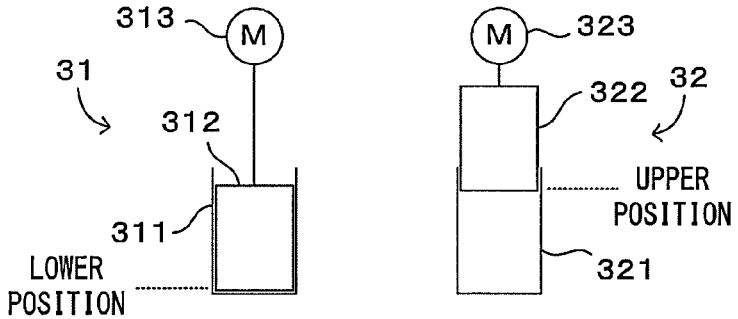
Figure 5D:
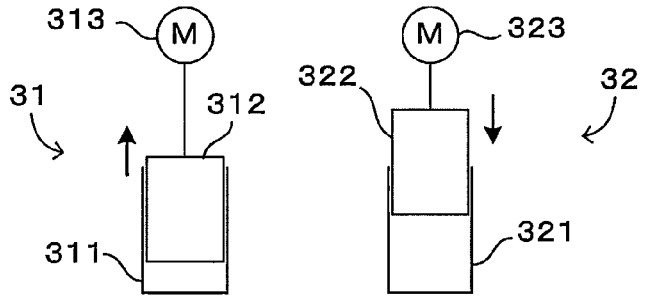

Before the piston 312 of the first syringe 31 reaches the lower position as shown in FIG. 5C, the piston 322 of the second syringe 32 is pulled up to the upper position to complete the filling of the application liquid. Subsequently, as shown in FIG. 5D, the application liquid is filled into the first syringe 31 while the application liquid is fed under pressure by pushing down the piston 322 of the second syringe 32. When the piston 322 of the second syringe 32 reaches the lower position, a return is made to the state of FIG. 5A and the pressure feed of the application liquid by the first syringe 31 and the filling of the application liquid into the second syringe 32 are performed.

To apply the constant pressure to the application liquid supplied to the discharge pump 41 without interruption, the operations of the two syringe pumps need to be smoothly switched. Specifically, it is necessary to pressurize the application liquid without interruption and not to fluctuate a pressing force in a transition from the state shown in FIG. 5A to that shown in FIG. 5B and a transition from the state shown in FIG. 5C to that shown in FIG. 5D. A specific operation of each component to enable this is described below with reference to FIG. 6.

Figure 6:
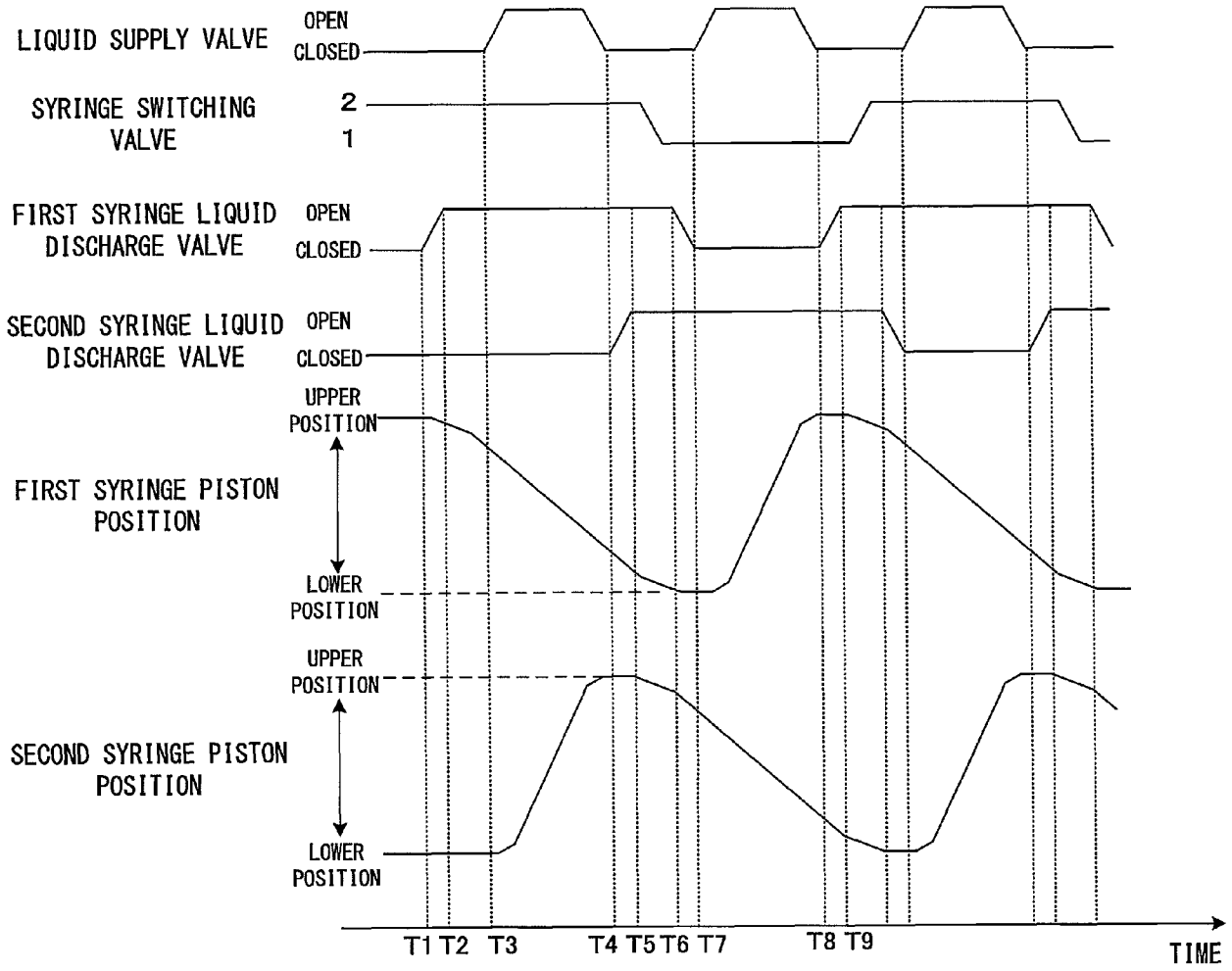
FIG. 6 is a timing chart showing the operation of each component.

FIG. 6 is a timing chart showing the operation of each component. This timing chart corresponds to a series of operations from the start of the flow of the application liquid from the hopper tank 10 to the nozzle 50 to the continuous discharge of a fixed amount of the application liquid from the nozzle 50. First, an initial state of each component is as follows.

The supply pump 22 constantly operates to cause the application liquid to flow from the hopper tank 10 to the pipe 21. The liquid supply valve 23 closes the flow path to the pipe 24 leading to the pressurizing unit 30 as shown in FIG. 6. On the other hand, the recirculation flow path by way of the recirculation pipe 25 is opened. This causes the application liquid fed from the bottom part of the hopper tank 10 to be returned to the hopper tank 10 via the pipes 21, 25. By circulating the application liquid in this way, an increase in viscosity due to the retention of the application liquid can be suppressed.

The syringe switching valve 33 is in a state "2", i.e. a state where the flow path on the side of the pipe 342 leading to the second syringe 32 is open and the flow path on the side of the pipe 341 leading to the first syringe 31 is closed. Further, both the first syringe liquid discharge valve 361 and the second syringe liquid discharge valve 362 are closed, and the flow paths from the first and second syringes to the discharge pump 41 are closed. Further, although not shown in FIG. 6, the discharge pump 41 is stopped and both the nozzle flow path opening valve 45 and the return flow path opening valve 46 are closed.

Note that, in an actual operation, the discharge pump 41 constantly operates and either one of the nozzle flow path opening valve 45 and the return flow path opening valve 46 is selectively opened to prevent the stagnation of the application liquid in the liquid feeding system. The application liquid is fed by the discharge pump 41, and discharged from the nozzle 50 via the output pipe 43 or return to the hopper tank 10 by way of the recirculation pipe 44, thereby constantly flowing. Here, a virtual state where the flow of the application liquid is stopped at and downstream of the pressurizing unit 30 is shown to make a transition from an operation start point of each component easily understandable.

A sufficient amount of the application liquid is filled in the first syringe 31 and the piston 312 is located at the upper position. On the other hand, the piston 322 of the second syringe 32 is located at the lower position and the application liquid is hardly filled in the second syringe 32. That is, the state shown in FIG. 5A is set.

From the above initial state, the first syringe liquid discharge valve 361 is opened at time T1 to open the flow path from the first syringe 31 to the discharge pump 41. Although not shown, the operation of the discharge pump 41 is started and the return flow path opening valve 46 is opened at this time. Thus, the flow path of the application liquid from the first syringe 31 to the hopper tank 10 via the discharge pump 41 and the recirculation pipe 44 is opened.

After time T2 at which the first syringe liquid discharge valve 361 is completely opened, the first syringe drive motor 313 operates and the piston 312 starts being pushed down. At this time, the piston 312 is preferably accelerated in a stepwise manner. This causes the application liquid stored in the cylinder 311 to be pressurized and the pressure feed of the application liquid from the first syringe 31 to the discharge pump 41 is started. By feeding the pressurized application liquid while operating the discharge pump 41 at a constant speed, the application liquid is fed at a constant flow rate from the discharge pump 41. Since the flow rate of the application liquid immediately after the start of the feed may not be possibly stable, the application liquid is desirably initially returned to the hopper tank 10 via the recirculation pipe 44 and fed to the nozzle 50 by opening the nozzle flow path opening valve 45 (closing the return flow path opening valve 46) at an appropriate timing after the flow rate becomes stable.

The CPU 91 adjusts the push-down speed of the piston 312 by controlling the first syringe drive motor 313 based on the pressure detection result of the pressure sensor 38. In this way, the pressure of the application liquid at the side upstream of the discharge pump 41 is maintained at a constant positive pressure.

The application liquid is filled into the second syringe 32 while being fed under pressure from the first syringe 31. Specifically, the liquid supply valve 23 is opened to open the flow path connecting the pipes 21 and 24 (close the recirculation flow path via the recirculation pipe 25) at time T3. At this time, a flow path connecting the pipe 24 and the pipe 342 is formed by the syringe switching valve 33. Thus, the application liquid supplied from the hopper tank 10 via the pipe 21 is supplied to the second syringe 32 by way of the pipes 24 and 342. Therefore, the application liquid is filled into the second syringe 32 by operating the second syringe drive motor 323 to pull up the piston 322.

At this time, the CPU 91 controls the second syringe drive motor 323 based on the pressure detection result by the pressure sensor 26. Specifically, the pull-up speed of the piston 322 is so adjusted that the detected pressure is a positive pressure in a predetermined range. If the pull-up speed of the piston 322 is too fast, the supply of the application liquid from the hopper tank 10 via the supply pump 22 may be delayed and air bubbles may be generated in the flow path or the pressure of the application liquid in the flow path may decrease to cause a reverse flow. However, such a problem can be avoided by pulling up the piston 322 while monitoring the pressure in the flow path. Further, the pull-up speed of the piston 322 is so adjusted that the application liquid is completely filled into the second syringe 32 before all the application liquid in the first syringe 31 is pushed out. When the piston 322 reaches the upper position, the second syringe drive motor 323 is stopped and the liquid supply valve 23 is closed. The application liquid fed from the supply pump 22 is recirculated to the hopper tank 10 via the recirculation pipe 25 again.

After the filling of the application liquid into the second syringe 32 is completed, the second syringe liquid discharge valve 362 is opened at time T4 at which the remaining amount of the application liquid in the first syringe 31 decreases to a predetermined value. Then, at time T5 at which the second syringe liquid discharge valve 362 is fully opened, the piston 322 of the second syringe 32 starts being pushed down and the push-down speed of the piston 313 of the first syringe 31 is reduced. This causes the application liquid to be pushed out from both the first and second syringes 31, 32 and fed under pressure to the discharge pump 41 from time T5 to time T6 at which the piston 312 of the first syringe 31 reaches the lower position and the pressure feed is stopped.

Immediately before the feed of the application liquid from the first syringe 31 is stopped, it is unavoidable that the pressing force is weakened due to a gradual reduction of the liquid feeding amount. Accordingly, a reduction in the pressing force can be prevented by starting the pressure feed of the application liquid from the second syringe 32 to compensate for a reduction in the feeding amount from the first syringe 31. In other words, the CPU 91 causes the second syringe drive motor 323 to operate so that the detected pressure by the pressure sensor 38 is constant also while an output from the first syringe 31 is being reduced. This can enhance the stability of the pressure of the application liquid supplied to the discharge pump 41 and prevent a fluctuation of the flow rate of the application liquid from the discharge pump 41.

At time T6 at which the piston 312 of the first syringe 31 reaches the lower position, the first syringe drive motor 313 is stopped and the application liquid is fed under pressure only from the second syringe 32 thereafter. Also during this period, a fluctuation of the flow rate of the application liquid from the discharge pump 41 can be prevented by controlling the second syringe drive motor 323 so that the detected pressure by the pressure sensor 38 is constant.

While the application liquid is fed under pressure from the second syringe 32 in this way, the application liquid is filled into the first syringe 31. Specifically, the first syringe liquid discharge valve 361 is closed at time T6 and the liquid supply valve 23 is opened again at and after time T7 at which the first syringe liquid discharge valve 361 is completely closed. Prior to this, the syringe switching valve 33 is switched to a state "1", i.e. a state where the flow path on the side of the pipe 341 leading to the first syringe 31 is open, whereas the flow path on the pipe 342 leading to the second syringe 32 is closed. As at the time of filling into the second syringe 32, the application liquid is filled into the first syringe 31 by pulling up the piston 312 by the first syringe drive motor 313 while monitoring the detected pressure by the pressure sensor 26. When the filling is completed, the liquid supply valve 23 is closed.

At time T8 after the filling into the first syringe 31 is completed, the first syringe liquid discharge valve 361 is opened again. At time T9 at which the first syringe liquid discharge valve 361 is fully opened, the piston 312 of the first syringe 31 starts being pushed down and the push-down speed of the piston 323 of the second syringe 32 is reduced. This causes the feeding amount of the application liquid from the second syringe 32 to be gradually reduced and, on the other hand, causes the feeding amount from the first syringe 31 to be increased, wherefore the total amount of the application liquid fed under pressure to the discharge pump 41 is maintained.

When the main component for feeding the application liquid under pressure is switched from the second syringe 32 to the first syringe 31 in this way, a fixed amount of the application liquid can be constantly and continuously fed from the discharge pump 41 by cyclically repeating the above operations thereafter. By selectively opening the nozzle flow path opening valve 45 and the return flow path opening valve 46 at appropriate timings, the flow path of the application liquid is switched between the side of the nozzle 50 and the side of the recirculation pipe 44. When the flow path to the nozzle 50 is opened, the application liquid is discharged from the nozzle 50 and coated on the base material S. On the other hand, when the flow path on the side of the recirculation pipe 44 is opened, the discharge of the application liquid from the nozzle 50 is stopped and the application liquid is returned to the hopper tank 10. During this period, the feeding amount of the application liquid from the discharge pump 41 is constant.

Next, the internal structure of the hopper tank 10 is described. As described above, the hopper tank 10 stores the highly viscous paste-like application liquid in the inner space and supplies the application liquid to the supply pump 22 via the pipe 21. The stirring wings are provided in the inner space of the hopper tank 10, thereby maintaining the fluidity of the application liquid. Since the application liquid has highly viscosity, the suction ability of the supply pump 22 may be insufficient in the pipe 21 from the hopper tank 10 to the supply pump 22. The supply pump 22 is provided for the purpose of assisting the filling of the application liquid into the first and second syringes 31, 32. In this sense, it is sufficient if a pump having a sufficient margin in discharge ability is applied so that a necessary feeding amount is ensured even if volume efficiency is reduced, and strict quantitativity is not required for the feeding amount. However, to stably feed the application liquid, it is more preferable to adopt such a configuration that the application liquid is actively fed from the hopper tank 10. The structure of the hopper tank 10 for forming such a flow of the application liquid is described below by way of several examples.

FIGS. 7 to 10 are views respectively showing four examples of the internal structure of the hopper tank. Note that components having the same structures as the already described ones are denoted by the same reference signs and not described in the following description with reference to FIGS. 7 to 10.

Figure 7:
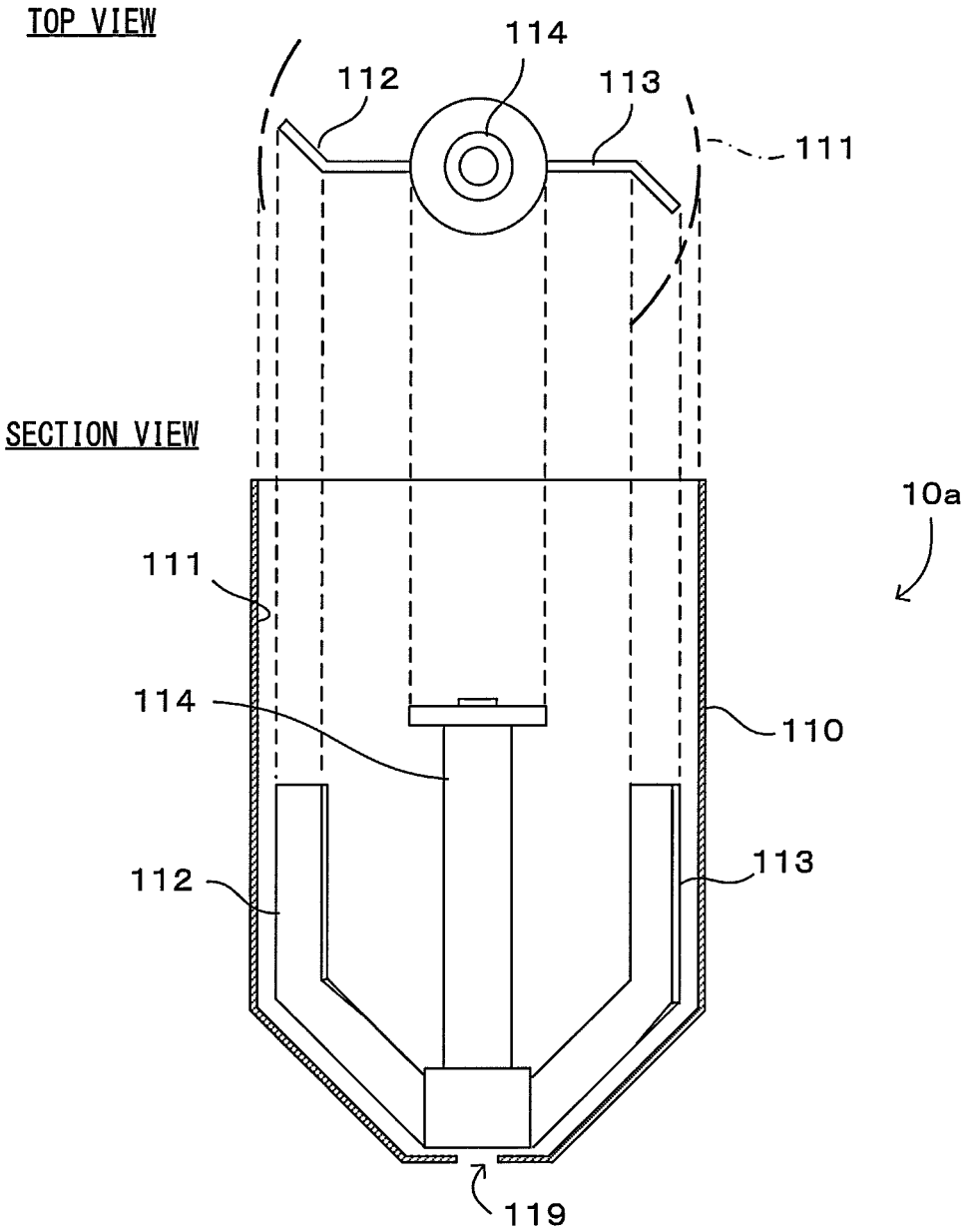
FIGS. 7 to 10 are views respectively showing four examples of the internal structure of the hopper tank.

In a hopper tank 10*a* as a first example shown in FIG. 7, a pair of stirring wings 112, 113 and a rotary shaft 114, which rotates in a tank main body 110 while supporting one end (lower end) of each of the stirring wings 112, 113, are provided. The stirring wings 112, 113 are substantially L-shaped plate-like members extending from a tapered part at a bottom part of the tank main body 110 toward a straight trunk part in an upper part along an inner wall 111 of the tank main body 110, and shaped by twisting flat plate materials by about 45° between parts extending along the tapered part and the those extending along the straight trunk part.

By rotating the stirring wings having such a structure in the hopper tank 10*a*, a shear force is constantly applied to the application liquid in the tank (particularly near the inner wall 111) and the flow of the application liquid from the upper part to the bottom part of the tank is generated. This promotes the outflow of the application liquid from the tank bottom part, whereby the application liquid is smoothly fed by the supply pump 22 via the pipe 21 (FIG. 1) connected to a supply port 119 provided on the tank bottom part.

Figure 8:
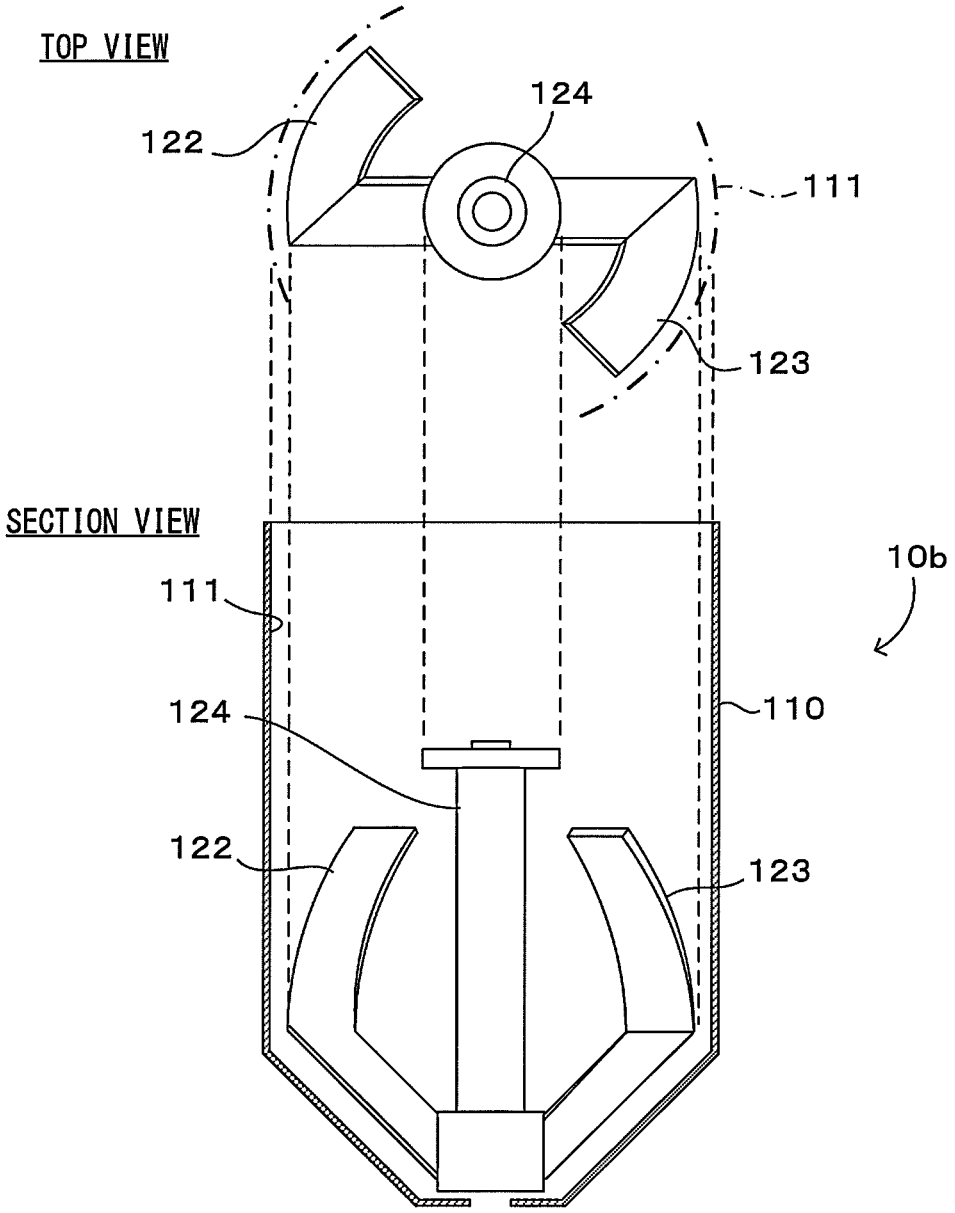

Further, in a hopper tank 10*b* as a second example shown in FIG. 8, stirring wings 122, 123 fixed to a rotary shaft 124 are further curved as compared with the first example. This further promotes the fluidity of the application liquid in the tank and the flow of the application liquid toward a bottom part.

Figure 9:
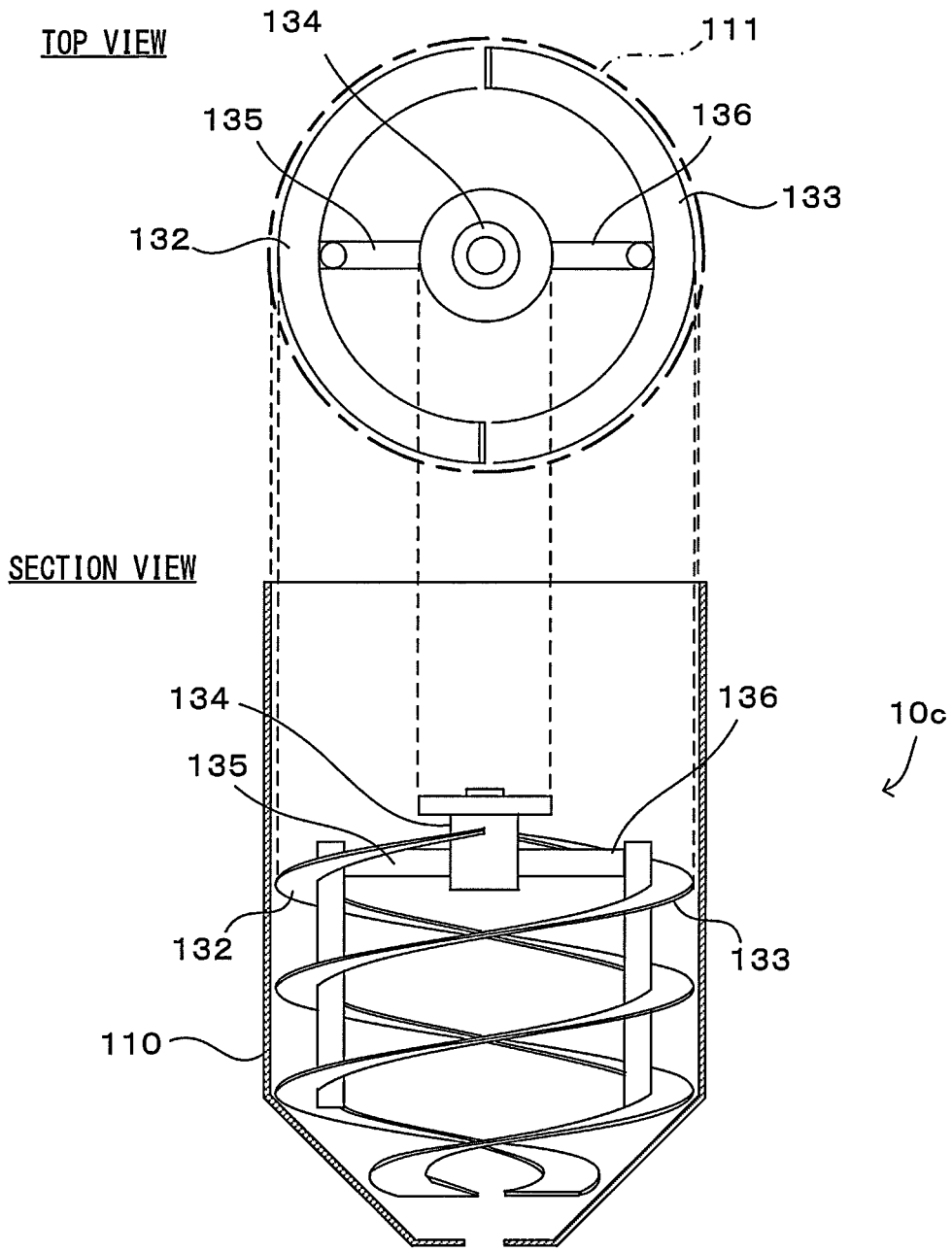

In a hopper tank 10*c* as a third example shown in FIG. 9, a pair of ribbon-like stirring wings 132, 133 each having a spiral shape are supported by a pair of support arms 135, 136 extending from a rotary shaft 134. According to such a structure, an eddy flow of the application liquid is generated in the tank by the rotation of the rotary shaft 134, thereby generating a strong flow of the application liquid toward a bottom part in the tank.

Figure 10:
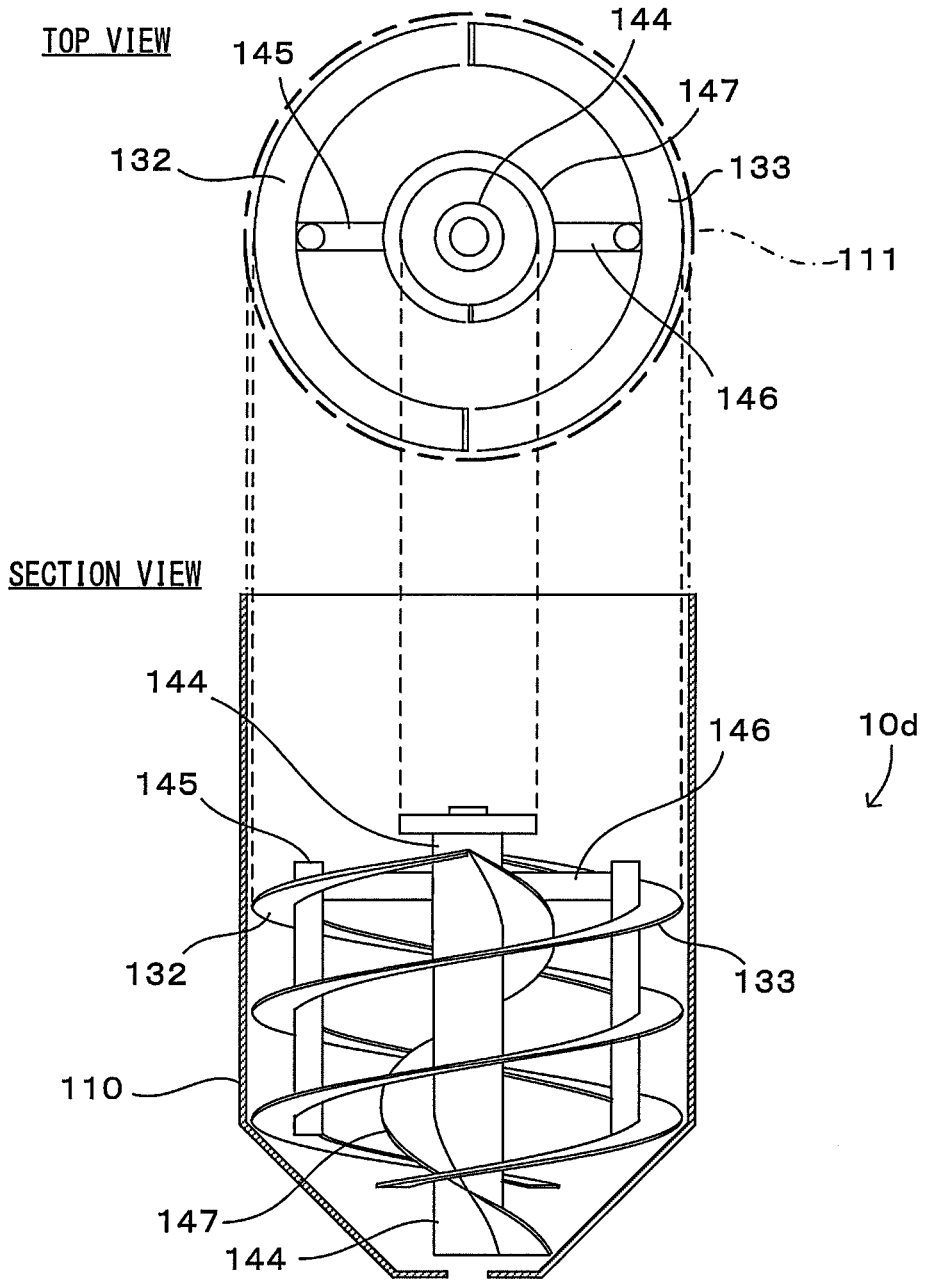

A hopper tank 10*d* as a fourth example shown in FIG. 10 includes a rotary shaft 144 structured by extending the rotary shaft 134 in the hopper tank 10*c* of the third example and support arms 145, 146, and a spiral screw wing 147 is further mounted on the rotary shaft 144. By such a structure, a stronger eddy flow can be generated.

By any of these structures, it is possible not only to merely stir the application liquid in the tank and cause the application liquid to flow, but also to generate the flow of the application liquid toward the tank bottom part. This enables the outflow of the application liquid from the tank bottom part to the pipe 21 and the application liquid to be actively fed to the supply pump 22. As a result, the volume efficiency of the supply pump 22 can be improved and the application liquid can be stably fed. Further, a high capacity pump is not necessary and the miniaturization and cost reduction of the apparatus can be realized by optimizing the capacity of the supply pump 22.

As described above, in this applying apparatus 1, the discharge amount of the application liquid from the nozzle 50 is controlled by feeding a fixed amount of the application liquid by the discharge pump 41 provided on the flow path of the application liquid from the hopper tank 10 to the nozzle 50. By pressurizing the application liquid to be fed to the discharge pump 41 by the pressurizing unit 30, a reduction in volume efficiency due to the shortage of the suction ability of the discharge pump 41 for the highly viscous application liquid is suppressed. This enables the application liquid to be fed at a stable flow rate from the discharge pump 41. That is, even if the discharge pump 41 does not singly have a sufficient suction ability for the highly viscous application liquid, the application liquid can be fed at a constant flow rate with the assistance of the pressurizing unit 30.

The pressurizing unit 30 includes the pair of syringe pumps (first syringe 31, second syringe 32) having a function of temporarily storing the application liquid inside and pressurizing the stored application liquid, and these syringe pumps are connected to the flow path in parallel to each other. By causing a plurality of syringe pumps connected in parallel to operate in a complementary manner to alternately perform the pressurization of the application liquid to be fed and the filling of the application liquid inside, the application liquid can be continuously and stably fed under pressure to the discharge pump 41.

More specifically, a constant positive pressure is applied to the application liquid supplied to the discharge pump 41 by feeding the application liquid under pressure from at least one of the first and second syringes 31, 32. During that time, the application liquid is filled into the other syringe pump where pressurization is not performed. Immediately before the pressure feed from one syringe pump is finished, the pressure feed of the application liquid from the other syringe pump is performed while the pressure feed from the one syringe pump is continued. By doing so, a fluctuation of the pressure in switching the syringe pump as a main component for the pressure feed can be suppressed.

Further, the pressure sensor 38 is provided on the flow path from the first and second syringes 31, 32 to the discharge pump 41 and the first and second syringes 31, 32 are controlled based on the detected pressure. By doing so, the pressure of the application liquid supplied to the discharge pump 41 can be stabilized. Particularly, by constantly applying a constant positive pressure to the application liquid, the application liquid can be fed at a constant flow rate without pulsation from the discharge pump 41. The syringe pumps are suited to this purpose in having a simple structure and easily controlling the pressing force for fluid inside.

Further, the supply pump 22 is provided in the flow path of the application liquid from the hopper tank 10 storing the application liquid to the pressurizing unit 30. Thus, the highly viscous application liquid can be more reliably supplied from the hopper tank 10 to each syringe pump of the pressurizing unit 30.

Further, the screw pump, more specifically the mohno pump which is a uniaxial eccentric screw pump is used as the discharge pump 41. The mohno pump is suitably used in feeding highly viscous fluid at a low flow rate and also good in the stability of the flow rate. Particularly when the fluid is highly viscous, there is a concern about a reduction in suction ability. However, in this applying apparatus 1, the pressurizing unit 30 is provided upstream of the discharge pump 41 in the flowing direction of the application liquid. Thus, a problem of a fluctuation in the feeding amount due to the shortage of the suction ability is solved.

Further, the recirculation pipe 44 for returning the application liquid to the hopper tank 10 is provided to extend from the flow path downstream of the discharge pump 41 in the flowing direction of the application liquid. By doing so, the application liquid can constantly flow in the liquid feeding system from the hopper tank 10 to the discharge pump 41. This can prevent a reduction in fluidity due to the thixotropy property of the application liquid, wherefore a stable discharge control (on/off control of the discharge from the nozzle and control of the discharge amount) is possible.

Further, by providing the stirring wings 112, 113 or the like in the hopper tank 10 storing the application liquid inside to stir the application liquid, a shear force can be constantly applied to the application liquid. This can prevent a reduction in the fluidity of the application liquid in the tank due to the thixotropy property. At this time, by setting the shape of the stirring wings to generate the flow of the application liquid toward the tank bottom part connected to the external pipe 21 in the tank, the flow of the application liquid from the tank to the downstream side can be promoted. This enables the application liquid to be more stably fed.

As described above, in this embodiment, the highly viscous paste-like application liquid corresponds to a "discharge material" of the invention and the hopper tank 10 function as a "supply part" of the invention. The tank main body 110 corresponds to a "storage part" of the invention, whereas the stirring wings 112, 113 and the like correspond to a "stirring part" of the invention. Further, in this embodiment, the discharge pump 41 functions as a "feeder part" of the invention, whereas the supply pump 22 functions as a "guide part" of the invention. Further, the first syringe 31 and the second syringe 32 respectively function as "pressurizers" of the invention, and the inner spaces of the cylinders 311, 312 correspond to a "storage space" of the invention.

Further, in the above embodiment, the CPU 91, the motor driver 92 and the valve driver 93 integrally function as a "controller" of the invention, whereas the pressure sensor 38 functions as a "pressure detector" of the invention. The configuration of this applying apparatus 1 excluding the conveying unit 70 corresponds to a "discharge apparatus" of the invention.

Note that the invention is not limited to the above embodiment and various changes other than the aforementioned ones can be made without departing from the gist thereof. For example, although the mohno pumps are used as the supply pump 22 and the discharge pump 41 in the above embodiment, pumps of other types capable of feeding highly viscous fluid may be used. Applicable pumps include hydraulic cylinder pumps, drum pumps, plunger pumps and the like. Further, screw pumps of other types such as uniaxial pumps other than mohno pumps, biaxial pumps and screw pumps and the like can also be used.

Further, in the above embodiment, two syringe pumps are, for example, used as the "pressurizers" of the invention. However, configurations other than the syringe pumps can be used as the pressurizers provided that they can feed liquid while applying a controlled pressure to the liquid. Further, the number of the pressurizers is not limited to two and the application liquid (discharge material) may be pressurized by successively using three or more pressurizers. Further, the syringe pumps may be, for example, air-driven or cam-driven syringe pumps besides the syringe pumps driven by the motors. Further, the pressure applied to the discharge material by the pressurizers is not limited to the one constantly maintained at a fixed value as in this embodiment, and a slight fluctuation may be permitted in some cases if it does not fluctuate the feeding amount from the feeder.

Further, for example, the discharge amount from the nozzle 50 is adjusted by controlling the discharge pump 41, based on the detection result of the flowmeter 42 provided between the discharge pump 41 and the nozzle 50 in the above embodiment. However, without being limited such a mode, the discharge amount from the nozzle 50 may be adjusted by controlling the discharge pump 41 based on a pressure detection result of a pressure sensor provided between the discharge pump 41 and the nozzle 50.

Further, in the above embodiment, the supply pump 22 is, for example, provided between the hopper tank 10 and the pressurizing unit 30 so that the application liquid is reliably filled into the syringe pumps. However, the supply pump 22

(guider) may be omitted if there is no problem in the supply of the liquid to the "pressurizers".

Further, for example, the return flow path branched from the flow path from the discharge pump 41 to the nozzle 50 is, provided so as to return the application liquid to the hopper tank 10 when the application liquid is not discharged from the nozzle 50 in the above embodiment. However, the invention effectively functions also in an applying apparatus or a discharge apparatus provided with no such return flow path. Further, a return flow path returning to the hopper tank by way of the nozzle may be adopted.

Further, the applying apparatus 1 of this embodiment is an apparatus for producing an electrode for battery by applying the application liquid containing the active material as the discharge material to the current collector. However, the invention can be applied also to an applying apparatus having a different purpose. For example, the invention is applicable also to an apparatus for producing a solar cell by applying application liquid containing a conductive material to form a current collector electrode on a photoelectric conversion layer or an apparatus for forming an arbitrary functional layer, for example, on a glass substrate or the like for various display devices.

Furthermore, although this embodiment relates to the applying apparatus for applying the application liquid discharged from the nozzle 50 on the base material S, the invention can be applied to various discharge apparatuses for discharging a discharge material for various purposes without limiting the application to the discharge of a discharge material for such a purpose of applying the discharge material on an applying target.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A discharge apparatus, comprising:

a nozzle which discharges a paste-like discharge material supplied from a supply part;

a feeder part which is provided on a flow path of the discharge material from the supply part to the nozzle and feeds the discharge material in the flow path at a predetermined flow rate from the supply part side toward the nozzle side;

a plurality of pressurizers provided in parallel to each other on the flow path between the supply part and the feeder part and each having a function of temporarily storing the discharge material supplied from the supply part in a storage space and a function of pressurizing the discharge material stored in the storage space and feeding the discharge material under pressure to the feeder part; and a controller which causes at least one of the pressurizers to pressurize the discharge material in the flow path communicating with the feeder part so that a predetermined positive pressure is applied to the discharge material in the flow path and causes the discharge material to be supplied from the supply part to at least one of the pressurizers not pressurizing the discharge material.

2. The discharge apparatus according to claim 1, further comprising a pressure detector for detecting a pressure in the flow path from the plurality of pressurizers to the feeder part, wherein the controller controls the pressurizers based on a detection result of the pressure detector.

3. The discharge apparatus according to claim 1, wherein each of the pressurizers includes a syringe pump.

4. The discharge apparatus according to claim 1, comprising a guide part which is provided on the flow path from the supply part to the plurality of pressurizers and guides the discharge material supplied from the supply part to the plurality of pressurizers.

5. The discharge apparatus according to claim 1, wherein the feeder part includes a screw pump.

6. The discharge apparatus according to claim 1, comprising a return flow path for returning the discharge material from a side downstream of the feeder part in a flowing direction of the discharge material along the flow path to the supply part.

7. The discharge apparatus according to claim 1, wherein the supply part includes a storage part which stores the discharge material in an inner space and a stirring part which is provided in the inner space of the storage unit and generates a flow of the discharge material from the inner space toward the flow path while stirring the discharge material.

8. A method for discharging a paste-like discharge material from a nozzle, comprising:

a first step of arranging a pressurizer and a feeder part in order along a flowing direction of the discharge material on a flow path of the discharge material from a supply part configured to supply the discharge material to the nozzle;

a second step of feeding the discharge material supplied from the supply part under pressure to the feeder part by pressurizing the discharge material by the pressurizer; and a third step of feeding the discharge material fed under pressure from the pressurizer at a predetermined flow rate to the nozzle by the feeder part while performing the second step;

wherein:

in the first step, a plurality of the pressurizers each having a function of temporarily storing the discharge material supplied from the supply part in a storage space and a function of pressurizing the discharge material stored in the storage space and feeding the discharge material under pressure to the feeder part are disposed in the flow path in a state connected in parallel to each other; and in the second step, while at least one of the pressurizers applies a predetermined positive pressure to the discharge material in the flow path communicating with the feeder part by pressurizing the discharge material, the discharge material is supplied from the supply part to at least one of the pressurizers not pressurizing the discharge material.

9. The discharge method according to claim 8, wherein in the second step, each of the plurality of pressurizers is caused to operate so that a pressure in the flow path between the pressurizers and the feeder part is substantially constant.

10. The discharge method according to claim 8, wherein a pair of syringe pumps is used as the plurality of pressurizers and while the discharge material is pressurized by one syringe pump, the discharge material is supplied from the supply part to the other syringe pump.

11. The discharge method according to claim 8, wherein a screw pump is used as the feeder part.

12. The discharge method according to claim 8, wherein a return flow path for returning the discharge material fed from the feeder part to the supply part is provided, and the discharge of the discharge material from the nozzle and the return of the discharge material to the return flow path are selectively performed.

* * * * *